United States Patent [19]

Chapman

[11] Patent Number: 4,600,043

[45] Date of Patent: Jul. 15, 1986

[54] LOG SPLITTING APPARATUS

[76] Inventor: Vernon R. Chapman, Kakatahi R.D., Wanganui, New Zealand

[21] Appl. No.: 670,826

[22] Filed: Nov. 13, 1984

[30] Foreign Application Priority Data

Nov. 24, 1983 [NZ] New Zealand ..... 206387

[51] Int. Cl.[4] ..... B27L 7/00

[52] U.S. Cl. ..... 144/193 A; 144/3 K; 144/366

[58] Field of Search ..... 144/193 R, 193 A, 3 K, 144/366

[56] References Cited

U.S. PATENT DOCUMENTS

| | | | |
|---|---|---|---|
| 2,966,180 | 12/1960 | Bles | 144/193 R |
| 3,842,871 | 10/1974 | Jureiwicz | 144/193 A |
| 4,019,549 | 4/1977 | Williams | 144/193 R |
| 4,073,325 | 2/1978 | Krom, Jr. | 144/193 A |
| 4,380,258 | 4/1983 | Hanser | 144/193 A |
| 4,501,309 | 2/1985 | Sinden | 144/193 A |

*Primary Examiner*—W. D. Bray

*Attorney, Agent, or Firm*—Ladas & Parry

[57] ABSTRACT

The invention is a log splitting apparatus which is fitted in place of the bucket on a back hoe. The splitter has a pivotal blade which in use is drawn towards the prime mover of the back hoe. In a second embodiment a claw half is provided forming with the blade a gripping means for lifting and carrying logs to be split by the blade.

6 Claims, 4 Drawing Figures

LOG SPLITTING APPARATUS

BACKGROUND OF THE INVENTION

1. Field of Invention

This invention relates to a log splitting apparatus. More particularly it relates to a log splitting apparatus adapted from a back hoe or loading shovel.

2. Description of Prior Art

The most relevant prior art of which the inventor is aware is discussed below.

French Patent Specification No. 2,529,821 describes a combined log splitting and log cutting apparatus. The blade is guillotine-like in construction for cross-cutting with a cross blade which is used for the splitting function. The framework which is described is installed permanently rather than on a prime mover.

U.K. Patent Specification No. 1,061,937 describes a log cutter rather than a log splitter. FIG. 2 of that specification shows the operation of a log cutter mounted on a back hoe but its operation is controlled by a separate added piston.

U.S. Pat. No. 4,019,549 is the most relevant to the present invention. A back hoe is modified so that a log lying horizontally may be split by the stick arm of the back hoe. The apparatus described has a blade which is mounted in a stationery position in juxtaposition with a set of rails forming a guide way for a log to be split. The log is moved by the end of the back hoe stick arm. This apparatus would be useful for the splitting of relatively short logs but would be limited by the length of the guide way in respect of longer logs.

U.S. Pat. No. 4,111,246 is also a log splitting device which is used as an attachment on a back hoe. The splitting is done by pushing downwards with a block against a piece of wood which is split by a fixed blade whose edge projects vertically upwardly.

U.S. Pat. No. 4,240,467 relates to a tractor hitch attachment consisting of a fixed blade and a movable piston and flat plate which co-operate with a pair of horizontal rails to split a log lying horizontally on the rails.

U.S. Pat. No. 4,340,098 also relates to a device for use with a tractor hitch. A fixed wedge like blade splits a log which is pressed against it by pivoting a platform on which a short log is impaled by spikes.

U.S. Pat. No. 4,444,241 is very similar to U.S. Pat. No. 4,111,246 except that in this case the blade is movable vertically downwardly and the log to be split rests on a flat surface.

As will be apparent from this prior art there are various requirements for different applications of log splitting. For example when the object is to produce firewood, relatively short lengths of log are split. When the object is to reduce the diameter of logs to feed them into a chipper at a pulp mill the logs to be split are relatively long. It is desirable to have a machine which is adaptable from similar apparatuses to be used in both of these applications.

It is an object of this invention to go some way towards achieving these desiderata or at least to offer the public a useful choice.

SUMMARY OF THE INVENTION

Accordingly the invention may be said broadly to consist in a log splitting apparatus comprising:

a blade mounted at the distal end of an arm, said arm being pivotally mounted at the end of a boom, said boom being pivotally mountable on a frame, means for pivoting said arm, means for pivoting said boom, said arm and said boom being pivotal about parallel axes, said blade being pivotal at said distal end of the said arm about an axis substantially parallel to said parallel pivot axes of said boom and, arm means for pivoting said blade, the arrangement being such that in use when a log to be split is aligned with its longitudinal axis substantially perpendicular to said parallel pivotal axes and has one end against an immovable abutment, and the cutting edge of said blade is applied to the other end of said log and said arm and boom are pivoted to pull the blade towards the base of the boom into said log end, the log is split.

Preferably said blade comprises a substantially straight cutting edge and is tapered outwardly to provide wedging as the cutting edge enters the log to be split.

Preferably said pivoting means comprises in each case a hydraulic ram.

Preferably each said hydraulic ram is a double acting hydraulic ram.

Preferably there is provided a pivotal claw mounted at the end of the said arm on a pivot axis substantially perpendicular to the pivot axes of said boom and said arm and means for pivoting said claw, the arrangement being such that in use said claw member can pivot to grasp logs between itself and the side of said blade.

Preferably said log splitting apparatus is mounted on a frame.

In one preferred embodiment said frame is mounted on or a part of, a farm tractor.

In another embodiment said log splitting apparatus is mounted on a turntable which is itself mounted on an undercarriage having a pair of tracks.

BRIEF DESCRIPTION OF THE DRAWINGS

The invention may be more fully understood by having reference to the accompanying drawings in which.

DETAILED DESCRIPTION OF THE DRAWINGS

Figure 1:
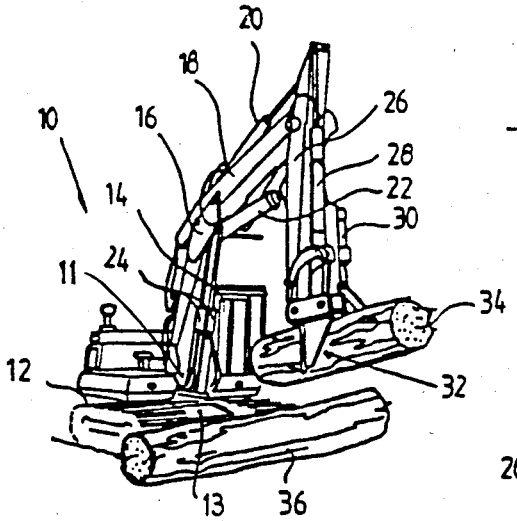
FIG. 1 is a perspective view of the apparatus.
Figure 2:
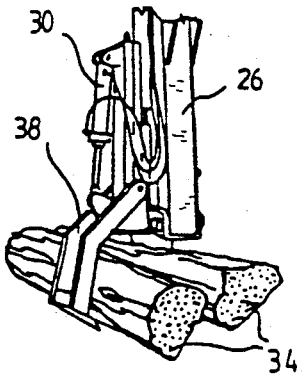
FIG. 2 is a perspective view looking forward from beside the left side of the cab of the apparatus illustrated in FIG. 1.

The apparatus comprises a main chassis given the general designation 10 provided with a pair of tracks 12 and mounted on a turntable 13 between the tracks 12 of the chassis. An operator's cab 14 is provided on the left hand front portion of chassis 10. Extending upwardly and forward from frame 11 on chassis 10 is a boom comprising a lower boom arm 16 and a upper boom arm 18. These two arms are welded together and cannot pivot relative to one another. The pair of boom arms 16 and 18 are pivotal from the chassis 10. Upper boom arm 18 has attached above it an upper hydraulic ram 20 and a lower hydraulic ram 22. Preferably these are double acting hydraulic rams. A second pair of hydraulic rams 24 each fixed at one end on the chassis 10 and at the other end to the joint of the boom portions 16 and 18. An arm 26 is pivotal at the end of the boom portion 18. Rams 20 and 22 pivot arm 26.

On the front face of arm 26 is a hydraulic ram 28. This pivots the blade member 32. The blade member 32 has a straight cutting edge 46 and an outwardly tapered wedging portion 48. Blade 32 is mounted on the bottom of a mounting bracket 44. One end 45 of the bracket 44 is pivotal at the bottom of arm 26. A connecting rod 42 connects the other end of bracket 44 to a bracket 40 which in its turn is pivotal on arm 26. Hydraulic ram 28 can pivot bracket 40, connecting rod 42, bracket 44 and hence blade 32.

Figure 3:
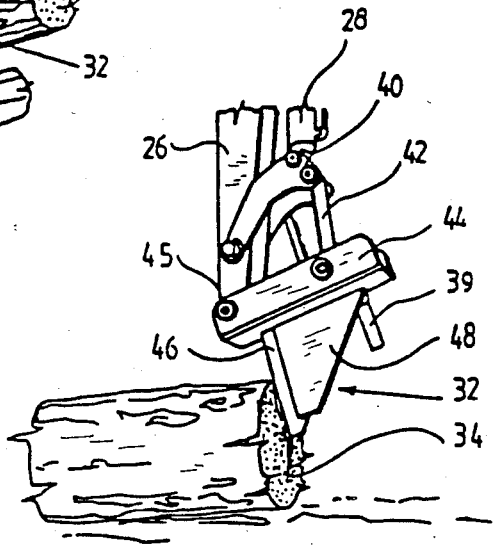
FIG. 3 is a perspective view in detail of the cutting blade of the apparatus as it enters a log.
Figure 4:
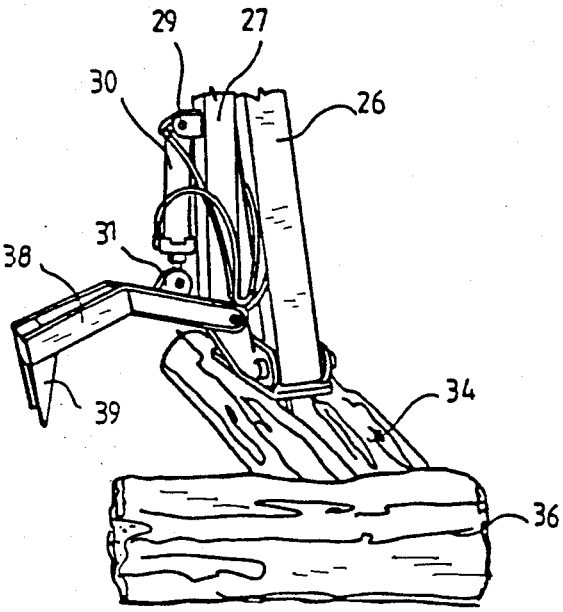
FIG. 4 is a view forward from the cab of the apparatus of a log being split.

Referring to FIGS. 3 and 4 it will be seen that on the left side of the arm 26 (facing forward) there is provided a pair of arms 38 ending in claw pieces 39. A hydraulic ram 30 is mounted at one end on a bracket 29 to a vertical member 27 which in its turn is mounted to arm 26. A second bracket 31 mounts other end of the hydraulic ram 30 to the claw arms 38.

In operation, the operator in cab 14 manoeuvres the vehicle to at least a pair of logs and takes a first log 36 and places it cross ways in front of the tracks 12. Boom 16, 18 and arm 26 are manoeuvred, in the manner of back hoe or a power shovel, so that the claw piece 38, 39 grasps logs 34 against the side of a blade 32. A second log 34 is aligned substantially perpendicular to log 36. Arm 26 is then manoeuvred to the position illustrated in FIG. 3. Ram 28 is positioned so that the blade edge 46 is substantially square to the end of log 34. At the beginning of the cut the blade edge 46 may be at a slight angle (shown in FIG. 3) to log 34 to drive it into the ground as arm 26 is pivotted towards log 36. The log is split by pulling the arm 26 and boom 16, 18 by operating hydraulic rams 20, 22 and 24 to draw the blade 46 along the length of log 34. Throughout the cut the blade edge 46 is maintained substantially perpendicular to the plane of the ground by gradually increasing the extension of ram 28 as the arm 26 and boom 16, 18 are drawn toward log 36. The relatively thin portion of blade 32 immediately behind cutting edge 46 allows the blade 32 to enter the log 34 relatively easily. When blade 32 has entered log 34 to the depth of wedging portion 48 the wedging action increases the width of the split along the log. In the case of logs without any knots this will generally result in the log 34 splitting along its entire length. If a knot is encountered as the blade is being drawn along log 34 the ram 28 can be operated back and forth to force the blade through the knot. Similarly the chassis 10 can be swung about the turntable to achieve the same effect.

The invention is illustrated in an embodiment particularly designed to split long logs for use in feeding to chippers at pulp mills. It will be appreciated by those skilled in the art that a back hoe adapted for use on the back of a farm tractor could equally be adapted to apply a blade of this type. It will be seen that if the logs are aligned to be split by other means (or manually) the claw piece is not a necessary part of that aspect of that the invention. The claw piece is a convenient addition to the basic splitting apparatus.

Other combinations of the invention within the scope of the appended claims will be apparent to those skilled in the art.

What is claimed is:

1. A log splitting apparatus comprising:
a blade mounted at the distal end of an arm,
said arm being pivotally mounted at the end of a boom,
said boom being pivotally mountable on a frame,
means for pivoting said arm,
means for pivoting said boom,
said arm and said boom being pivotal about parallel axes,
said blade being pivotal at said distal end of the said arm about an axis substantially parallel to said parallel pivot axis of said boom and arm,
means for pivoting said blade,
a pivotal claw mounted at the end of the said arm on a pivot axis substantially perpendicular to the pivot axis of said boom and said arm,
and means for pivoting said claw,
the arrangement being such that in use when a log to be split is grasped between said side of said blade and said claw member and thereby aligned with longitudinal axis substantially perpendicular to said parallel pivotal axes and has one end against an immovable abutment, and the cutting edge of said blade is applied to the other end of said log and said arm and boom are pivoted to pull the blade towards the base of the boom into said log end, the log is split.

2. An apparatus as claimed in claim 1 wherein said blade comprises a substantially straight cutting edge and is tapered outwardly to provide wedging as the cutting edge enters the log to be split.

3. An apparatus according to claim 2 wherein said means for pivoting said boom, arm and blade comprises in each case a hydraulic ram.

4. An apparatus according to claim 3 wherein said hydraulic ram is a double acting hydraulic ram.

5. An apparatus according to claim 1 wherein said log splitting apparatus is mounted on a frame.

6. An apparatus according to claim 5 mounted on a turntable which is itself mounted on an undercarriage having a pair of tracks.

* * * * *